US006473578B2

(12) United States Patent
Miyabe et al.

(10) Patent No.: US 6,473,578 B2
(45) Date of Patent: Oct. 29, 2002

(54) DEVELOPING APPARATUS

(75) Inventors: Shigeo Miyabe, Numazu; Tadayuki Tsuda, Susono; Shinjiro Toba, Shizuoka-ken, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/761,577

(22) Filed: Jan. 18, 2001

(65) Prior Publication Data

US 2001/0024581 A1 Sep. 27, 2001

(30) Foreign Application Priority Data

Jan. 18, 2000 (JP) ..... 2000-009015

(51) Int. Cl.[7] ..... G03G 15/04; G03G 15/08

(52) U.S. Cl. ..... 399/119; 399/90; 399/265; 399/270; 399/271

(58) Field of Search ..... 399/111, 119, 399/90, 252, 265, 267, 270, 271, 277, 279, 285

(56) References Cited

U.S. PATENT DOCUMENTS

| | | | | |
|---|---|---|---|---|
| 4,708,455 A | | 11/1987 | Kubota et al. | |
| 4,872,418 A | | 10/1989 | Yoshikawa et al. | 118/657 |
| 5,272,505 A | | 12/1993 | Shishido et al. | |
| 5,283,619 A | | 2/1994 | Nomura et al. | |
| 5,606,722 A | * | 2/1997 | Hart et al. | 399/270 |
| 5,634,175 A | | 5/1997 | Michlin et al. | 399/90 |
| 5,655,181 A | | 8/1997 | Chadani et al. | 399/114 |
| 5,682,587 A | | 10/1997 | Higeta et al. | 399/277 |
| 5,701,562 A | | 12/1997 | Araki et al. | 399/265 |
| 5,708,925 A | | 1/1998 | Kobayashi et al. | 399/120 |
| 5,739,900 A | | 4/1998 | Isobe | |
| 5,761,584 A | | 6/1998 | Tsuda et al. | 399/258 |
| 5,768,658 A | | 6/1998 | Watanabe et al. | 399/111 |
| 5,802,431 A | | 9/1998 | Nagashima et al. | 399/262 |
| 5,815,782 A | | 9/1998 | Yokomori et al. | 399/285 |
| 5,822,654 A | | 10/1998 | Damji et al. | 399/111 |
| 5,832,343 A | | 11/1998 | Kobayashi et al. | 399/119 |
| 6,151,465 A | | 11/2000 | Toba et al. | 399/90 |

FOREIGN PATENT DOCUMENTS

| | | |
|---|---|---|
| EP | 0 549 400 | 6/1993 |
| EP | 0 754 984 | 1/1997 |

OTHER PUBLICATIONS

U.S. patent application Ser. No. 09/559.144, filed Apr. 27, 2000.

U.S. patent application Ser. No. 09/559,145, filed Apr. 27, 2000.

U.S. patent applicatin Ser. No. 09/050,931, filed Mar. 31, 1998.

U.S. patent application Ser. No. 09/167,723, filed Oct. 07, 1998.

* cited by examiner

*Primary Examiner*—Hoang Ngo
(74) *Attorney, Agent, or Firm*—Fitzpatrick, Cella, Harper & Scinto

(57) ABSTRACT

A developing device includes a rotatable developer carrying member for carring a developer; a magnet roller provided in the developer carrying member; a first electrode portion connected electrically with the developer carrying member, the first electrode portion being rotatable with the developer carrying member; a second electrode portion provided with a contact portion in sliding contact with the first electrode portion, the contact portion being disposed outside a longitudinal end portion of the magnet roller substantially at a center of rotation of the developer carrying member.

22 Claims, 10 Drawing Sheets

(a)

(b)

DEVELOPING APPARATUS

FIELD OF THE INVENTION AND RELATED ART

The present invention relates to such a developing apparatus that develops an electrostatic image formed on an image bearing member, with the use of developer. This type of a developing apparatus is preferably used as a developing apparatus for an image forming apparatus such as a copying machine, printer, and the like.

As the cumulative usage time of an electrophotographic image forming apparatus reaches a certain point, it becomes necessary to replace the photosensitive drum, to replenish or replace developer, and/or to adjust, clean, and/or replace the charging device, cleaning means container, and the like. These maintenance operations have been generally difficult, except for service personnel with professional knowledge.

In order to eliminate this inconvenience, a process cartridge, or a cartridge in which an image bearing member (photosensitive drum), and a single or plural image processing means, for example, a developing apparatus, a cleaning apparatus, and the like, are integrally placed, has been commercialized.

As a result, it has become simple for users themselves to maintain an image forming apparatus, or replace the aforementioned processing means as it becomes necessary for an image forming apparatus to be maintained. Therefore, it has become easy and inexpensive to obtain high quality images.

The aforementioned developing apparatus, or one of the components which a process cartridge comprises, has a development roller as a developer bearing member which is placed in a manner to oppose a photosensitive drum as an image bearing member. The development roller has a development sleeve, and a magnetic roll. The magnetic roll is nonrotational and placed in the development sleeve, and the development sleeve is rotated about the magnetic roll. In order to transfer the toner uniformly borne on the peripheral surfaces of the development sleeve, onto an electrostatic latent image on the peripheral surfaces of the photosensitive drum, bias is applied to the development sleeve. As for a means for applying bias to the development sleeve, a method illustrated in FIG. 12 has been proposed. According to this method, a flange 102 formed of electrically conductive material is fixed to one of the longitudinal ends of a development sleeve 101, and an electrode 105 in the form of a compression coil spring is fitted around the flange 102 in a manner to allow electricity to flow between the two components. One end of the electrode 105 is attached to the housing 104 of a developing apparatus so that, as the developing apparatus is mounted in the main assembly of an image forming apparatus, the electrode 105 is placed in contact with an electrical contact electrically connected to a power supply provided on the main assembly side.

As for a means for supporting a magnetic roll 103, the housing 104 of the developing apparatus is provided with a positioning hole 104*a*, the axial line of which coincides with that of the development sleeve 101, and in which the smaller diameter portion 103*a* of the magnetic roll 103 is fitted to dictate the distance between the peripheral surfaces of the magnetic roll 103 and development sleeve 101. However, a much simpler magnetic roll supporting method than the above described one has been desired.

In the case of the above described magnetic roll supporting method, the electrode 105 or flange 102 rotates with the development sleeve 101 which sliding on the contact on the main assembly side. Therefore, it is a common practice to coat the contact areas of the electrode 105 and contact on the main assembly side. This contact area is desired to be as small as possible so that the interface in which the two components slide against each other becomes as small as possible.

In order to stabilize the contact pressure between the electrode 105 and contact on the main assembly side, it is desirable to reduce the spring constant of the elastic contact (compression coil spring which constitutes electrode 105), so that the amount of flexing of the electric contact increases. For this purpose, it, s necessary to provide the aforementioned developing apparatus with an internal space long in terms of the longitudinal direction of the developing apparatus.

SUMMARY OF THE INVENTION

The primary object of the present invention is to provide a developing apparatus, the sliding contact of which is smaller than a conventional one.

Another object of the present invention is to provide a developing apparatus, the sliding contact of which is more reliable than a conventional one.

Another object of the present invention is to provide a developing apparatus, the magnetic roll of which is positioned with a higher degree of accuracy than in the conventional one.

Another object of the present invention is to provide a developing apparatus, the spacial efficiency of which in terms of the longitudinal direction of the developing apparatus is superior to that of the conventional one.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, the preferred embodiments of the present invention will be described with reference to FIGS. 1 through 11(*c*).

Description of Process Cartridge and Image Forming Apparatus Main Assembly

Figure 1:
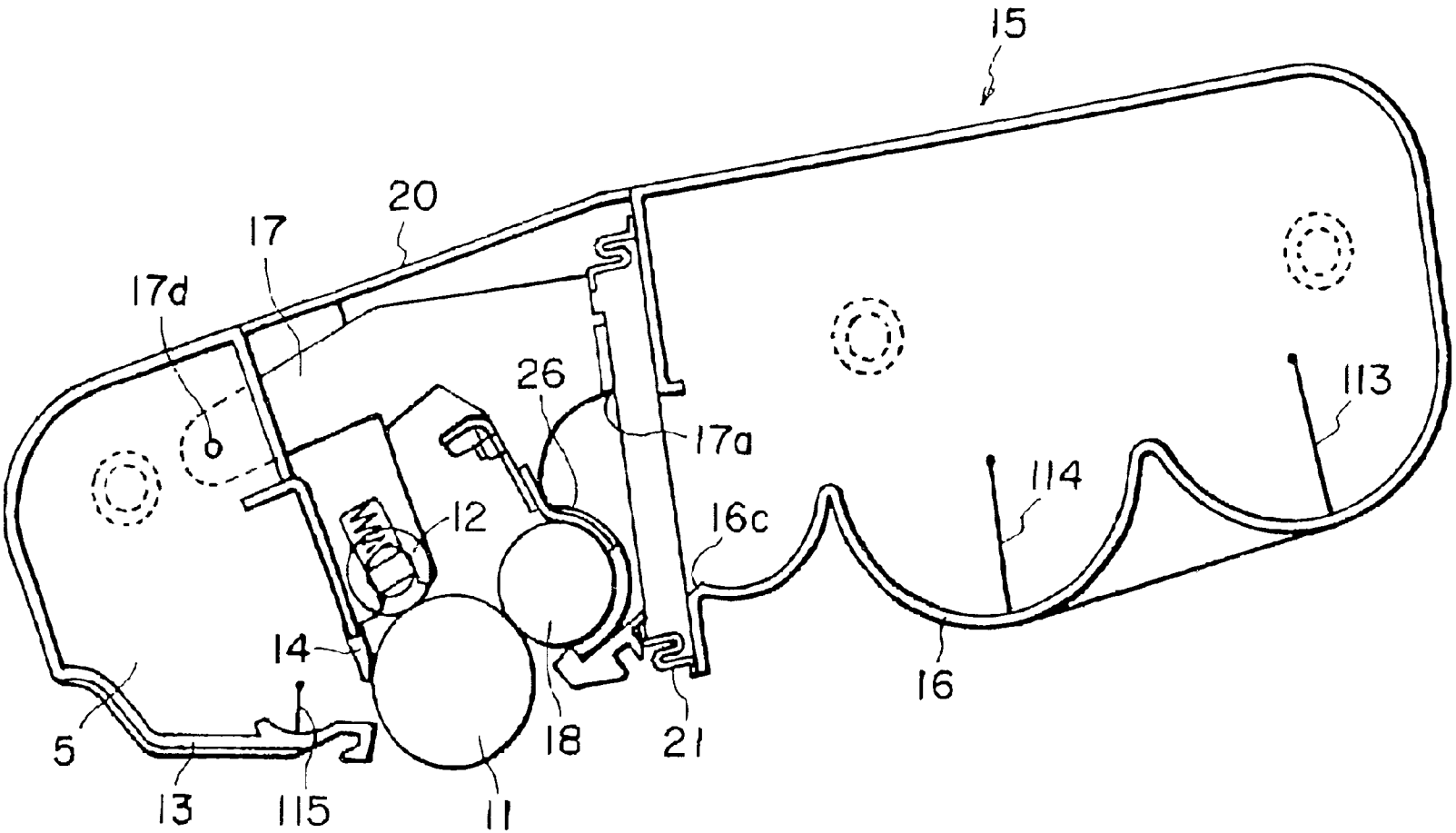
FIG. 1 is a schematic sectional view of the process cartridge in an embodiment of the present invention, at a plane perpendicular to the longitudinal direction of the process cartridge.
Figure 2:
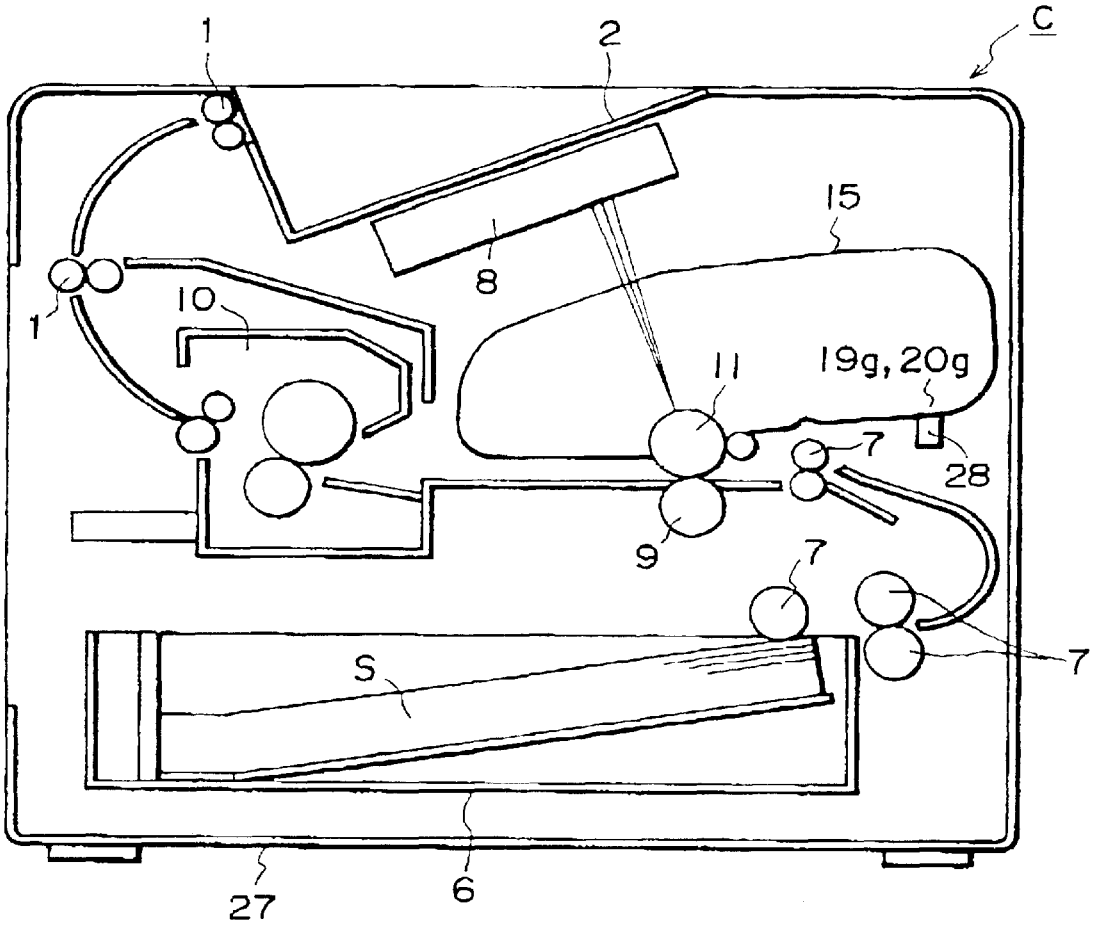
FIG. 2 is a schematic sectional view of the main assembly of an image forming apparatus in which a process cartridge is exchangeably mountable, at a plane perpendicular to the longitudinal direction of the process cartridge.

FIG. 1 is a sectional view of the process cartridge in an embodiment of the present invention, at a plane perpendicular to the longitudinal direction of the process cartridge, and FIG. 2 is a sectional view of the image forming apparatus in the embodiment of the present inventing, in which the process cartridge illustrated in FIG. 1 is exchangeably mountable, at a plane perpendicular to the longitudinal direction of the process cartridge in the image forming apparatus.

This process cartridge has an electrophotographic photosensitive drum (hereinafter, "photosensitive drum") as an image bearing member, and a single or plural processing means. As for the processing means, there are, for example, a charging means for charging the peripheral surfaces of the photosensitive drum, a developing apparatus for developing an electrostatic latent image on the photosensitive drum into a toner image, and a cleaning leans for removing the toner remaining on the peripheral surfaces of the photosensitive drum.

Referring to FIG. 1, the process cartridge in this embodiment comprises: a photosensitive drum 11 as an image bearing member, a charge roller 12 as a charging means, a development roller 18 as a developer bearing member, a development blade, a toner holding portion 16 in which toner is held, a cleaning blade 14 as a cleaning means, and a housing in which the preceding components are integrally placed so that they can be removably mounted in the main assembly C of an image forming apparatus. The development roller 18 and development blade are components of a developing apparatus. These components, except for the photosensitive drum 11, are placed around the peripheral surfaces of the photosensitive drum 11.

Referring to FIG. 2, the process cartridge 15 is mounted in the image forming apparatus main assembly C to be used for image formation. In an image forming operation, a sheet S is fed out of a sheet cassette 6 mounted in the bottom portion of the image forming apparatus, by a conveying roller 7. In synchronism with this feeding of the sheet S, the peripheral surfaces of the photosensitive drum 11 is selectively exposed to a beam of light projected from an exposing apparatus 8, to form a latent image on the peripheral surfaces of the photosensitive drum 11. Thereafter, the toner stored in the toner contained 16 is coated in a thin layer on the peripheral surfaces of the development roller 18 by a development blade, and development bias is applied to the development roller 18. As a result, the toner is supplied to the peripheral surfaces of the photosensitive drum 11 in accordance with the latent image, forming a toner image. This toner image is transferred onto the sheet S, which is being conveyed, by the application of bias voltage to transfer roller 9. Then, the sheet S is further conveyed to a fixing apparatus 10, in which the toner image is fixed to the sheet S Then, the sheet S is discharged into a delivery portion 2 located on top of the apparatus main assembly, by a sheet discharging roller 1.

Structure of Process Cartridge Frame

Figure 3:
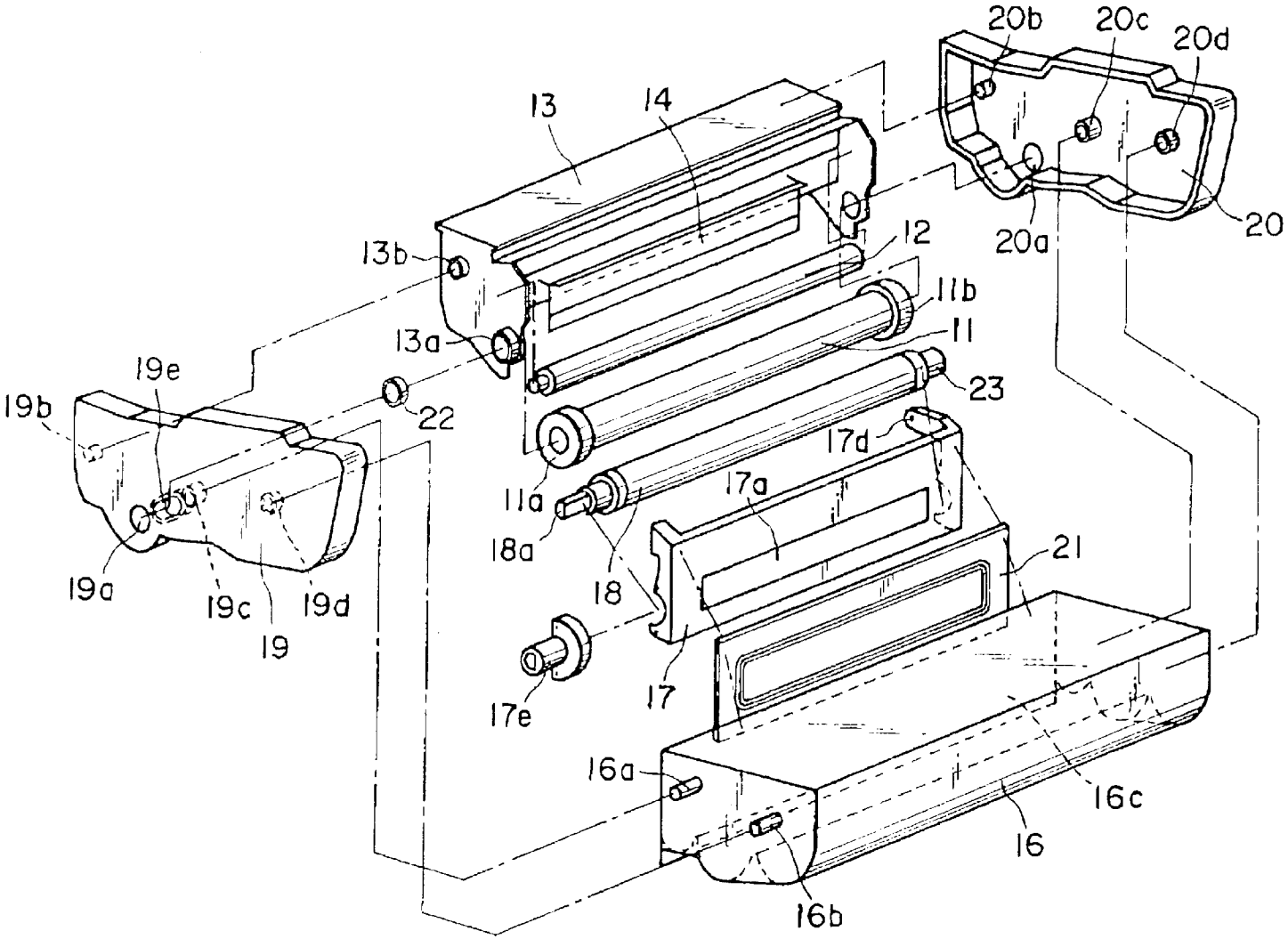
FIG. 3 is an exploded perspective view of the frame portions of the process cartridge illustrated in FIG. 1.
Figure 4:
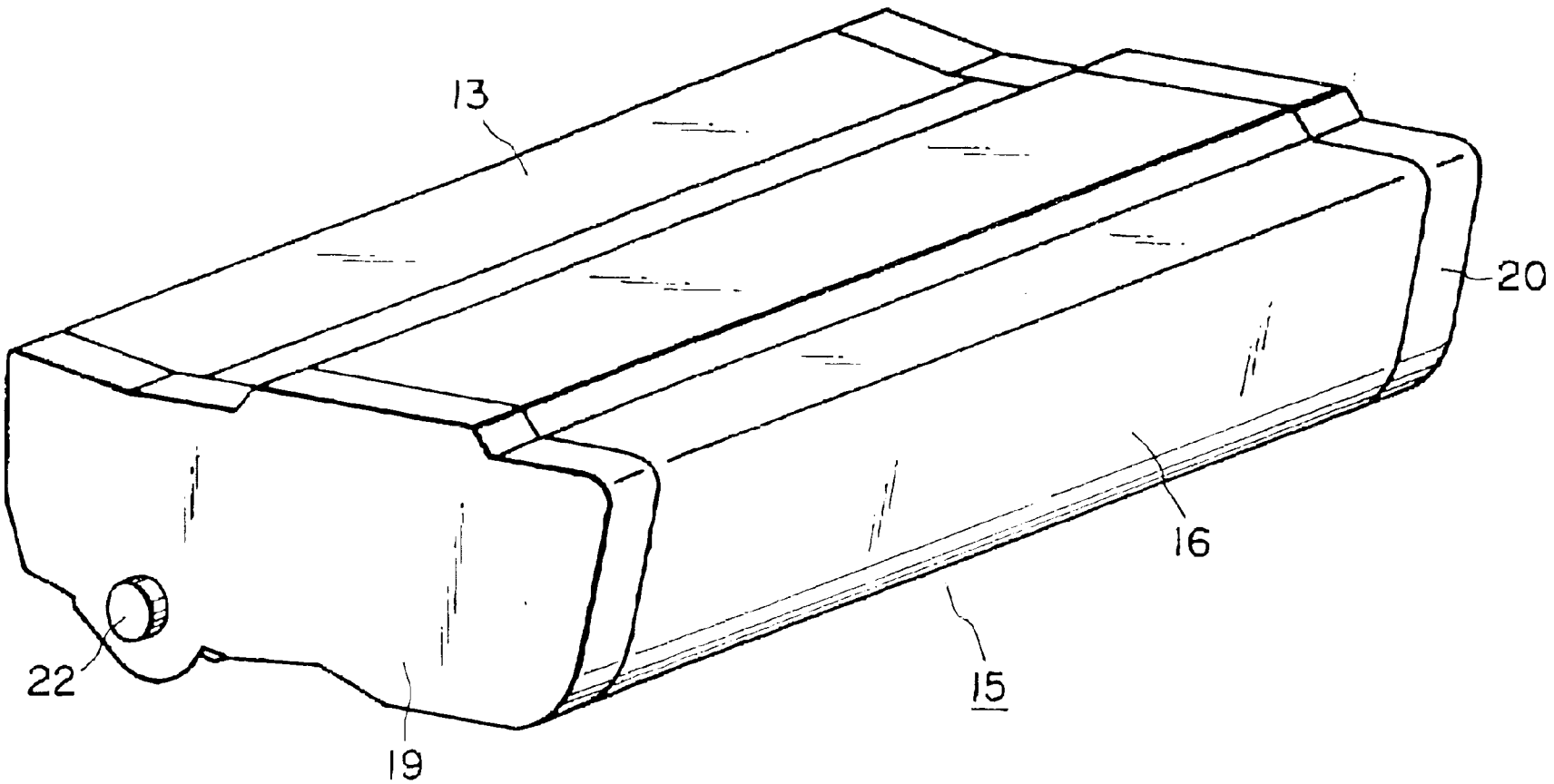
FIG. 4 is a perspective view of the process cartridge illustrated in FIG. 1.

FIGS. 3 and 4 are perspective views of the process cartridge. FIG. 3 is a drawing prior to the process cartridge assembly, whereas FIG. 4 is a drawing after the completion of the process cartridge assembly.

The process cartridge 15 comprises three frame portions: a cleaning means frame portion which integrally supports the photosensitive drum 11, charge roller 12, and cleaning blade 14; a developing means frame portion which supports the development roller 18 and development blade; and a toner holding frame portion 16 which holds toner. Three frame portions are positioned so that the developing means frame portion 17 is interposed between the cleaning means frame portion 13 and developer holding frame portion 16.

Further, in order to keep these three frame portions held together, side covers 19 and 20 are attached to the longitudinal ends of the three frame portions, one for one.

(1) Cleaning Means Frame Portion 13

In the cleaning means frame portion 13, the cleaning blade 14 is fixed to the cleaning means frame portion 13 with the use of small screws or the like, and the charge roller 12 is rotationally supported by a bearing (unillustrated) located at each of the longitudinal ends of the process cartridge to support the metallic core portion of the charge roller 12.

Also in the cleaning means frame portion 13, the photosensitive drum 11 is rotationally supported by the cleaning means frame portion 13, with the interposition of bearings 22 which supports the flange portions 11*a* and 11*b* located at the ends of the photosensitive drum 11, one for one.

(2) Toner Holding Frame Portion 16

The toner holding portion 16 contains a toner conveying member (unillustrated) as well as toner. The details of the developing means frame portion 17 will be described later. The side cover 19 on the nondriven side, that is, the side opposite to the side from which driving force is transmitted to the process cartridge 15 from the image forming apparatus main assembly, has a size which matches the size of the cross section of the process cartridge 15 at a plane perpendicular to the longitudinal direction of the process cartridge 15. The side cover 19 is placed on one of the longitudinal ends of the process cartridge 15, and holds together the cleaning means frame portion 13 and toner holding frame portion 16.

The side cover 19 is positioned in such a manner that the axial line of the hole 19*a* of the side cover 19 coincides with that of the axial line of the photosensitive drum 11 within the cleaning means frame portion 13. The position of the side cover 19 can be highly precisely fixed with the interposition of the bearing 22. The positioning portion 19*b* of the side cover 19 is located on the inward surface of the side cover 19 so that the distance between the positioning portion 19*b* and the photosensitive drum 11 after the attachment of the side cover 19 to the cleaning means frame potion 13 and developer holding frame portion 16 becomes as large as possible. The attitude of the side cover 19 relative to the cleaning means frame portion 13 is dictated by the engagement of the positioning portion 19*b* with a positioning portion 13*b* provided on the outward surface of the side wall of the cleaning means frame portion 13. The side cover 19 and cleaning means frame portion 13 are fixed to each other, with the use of several small screws.

The toner holding frame portion 16 is provided with positioning portions 16*a* and 16*b*, which are located on the side wall of the toner folding frame portion 16. The attitude of the toner holding frame portion 16 relative to the side wall 19 is dictated by the engagement of the positioning portions 16*a* and 16*b* with the positioning portions 19*c* and 19*d*, respectively, located on the inward side of the side cover 19. The side cover 19 and toner holding frame portion 16 are fixed to each other with the use of several small screws.

Also, the side cover 20, or the side cover on the driven side of the process cartridge, positions the developing means frame portion 17 with the use of a method which will be described later.

The bearing 22 doubles as a member for positioning the process cartridge 15 relative to the image forming apparatus. Since toner is supplied to the development sleeve 18 from the toner holding frame portion 16, the toner holding frame portion 16 and developing means frame portion 17 are provided with holes 17*a* and 16*c*, respectively.

The developing means frame portion 17 and toner holding frame portion 16 are connected to each other, with the interposition of a sealing member 21, in such a manner that the holes 17*a* and 17*c* align with each other.

Toner Holding Frame Portion

The toner holding frame portion 16 is fixed to the side covers 19 and 20, and the developing means frame portion 17 is fixed to the cleaning means frame portion 13. Therefore, it is possible that either the developing means frame portion 17 or toner holding frame portion 16 will be deformed due to the errors in the dimensions of the two frame portions. Therefore, the sealing member is formed of flexible material.

With the provision of the above described structural arrangement, even if the amount of toner is increased, the load from the toner falls on the side covers; it does not fall on the development sleeve. In other words, since the load from toner is not transmitted to the developing means frame portion 17 regardless of the amount of the toner within the toner holding frame portion 16, the positional relationship between the development sleeve 18 and photosensitive drum 11 is precisely maintained. Therefore, the photosensitive drum 11 is not subjected to an excessive amount of load, making it possible for the image forming apparatus to continuously produce high quality images.

In addition, this structural arrangement of connecting these frame portions by their longitudinal ends makes it possible to position these frame portions relative each other, with the use of only side covers, which in turn makes it possible to connect these frame portions with a high degree to precision.

Structure of Developing Means Frame Portion

The developing means frame portion 17 holds the development roller, the development blade, and a magnetic seal (unillustrated). The development roller comprises the development sleeve 18 and magnetic roll 26.

The magnetic roll 26 is supported by the internal surface of the development roller in a manner to keep contact the gap between the magnetic roll 26 and the development sleeve 18 The power to the development sleeve 18 is supplied through an electrical contact point placed within the development sleeve 18. These arrangements will be described in .detail later. The development roller is provided with spacer rings (unillustrated), which are fitted around the development roller to maintain a predetermined gap between the development roller and photosensitive drum 11.

Figure 6:
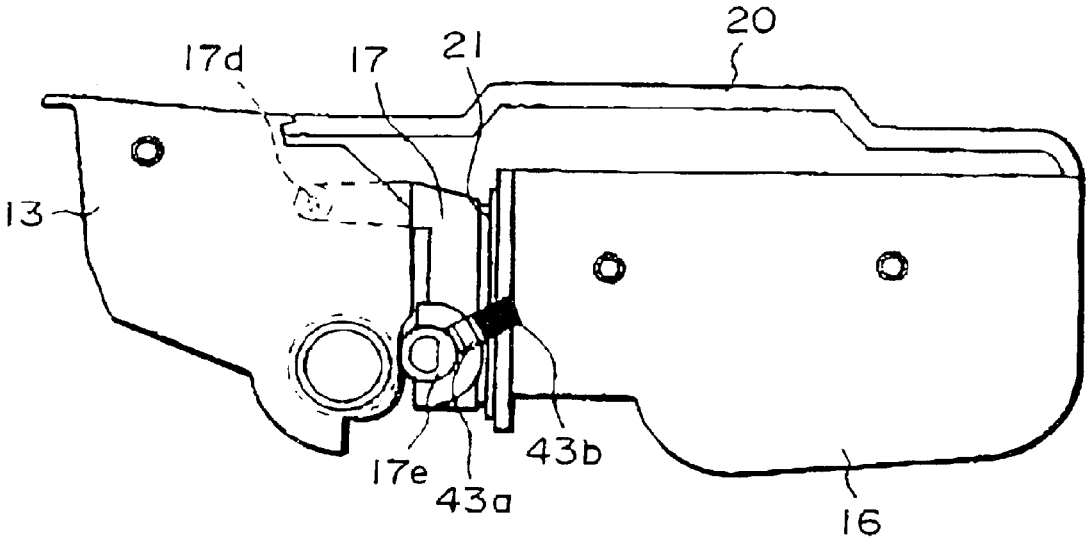
FIG. 6 is a plan view of the longitudinal end of the process cartridge, prior to the placement of the side cover, on the side from which the process cartridge is not driven.
Figure 7:
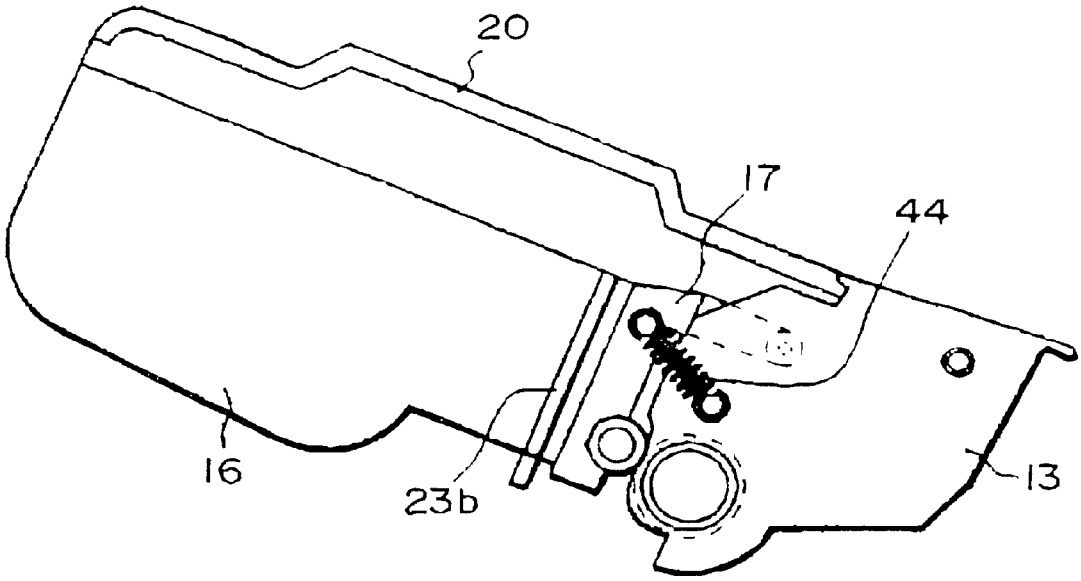
FIG. 7 is a drawing for depicting the movements of the two frame portions of the process cartridge relative to each other.

Referring to FIG. 6, the developing means frame portion 17 is supported in such a manner to allow the developing means frame portion 17 to pivot about the axial line of the hole 17*d* of the developing means frame portion 17 located on the driven side (right side in FIG. 3) of the development sleeve 18, in such a manner that the axial line of the development sleeve 18 moves toward the axial line of the photosensitive drum 11.

In other words, the developing means frame portion 17 comprising the development sleeve 18 is attached to the driving side of the cleaning means frame portion 13 in a manner to allow the developing means frame portion 17 to pivot about the axial line of the hole 17*d*. Since the cleaning means frame 13 and toner holding trade portion 16 are solidly fixed to each other as described above, the developing means frame portion 17 is movable relative to the toner holding frame portion 16.

Figure 5:
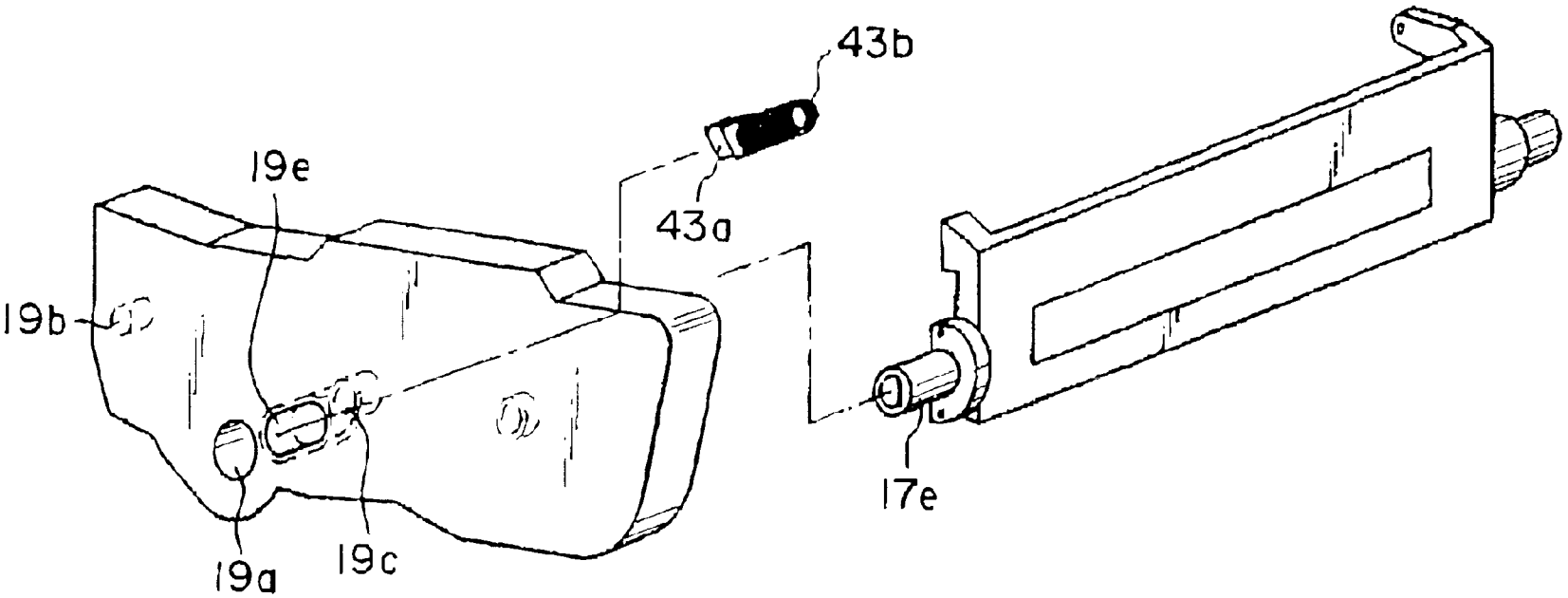
FIG. 5 is a perspective view of the developing means frame portion of the process cartridge illustrated in FIG. 1.

In addition, referring to FIGS. 5 and 6, the nondriven end of the developing means frame portion 17 in terms of the longitudinal direction of the development sleeve 18 is provided with a developer roller pressing sleeve 17*e* (one end of the magnetic roll 26 is fitted in this sleeve 17*e*), the axial line of which coincides with the axial line of the development roller. The developing means frame portion 17 is structured so that the axial line of this development roller pressing sleeve 17*e* is pressed toward the axial line of the photosensitive drum 11.

The development roller pressing sleeve 17*e* is inserted in an elongated groove 19*e* (in this embodiment, an elongated straight hole parallel with the radial direction of the photosensitive drum 11) in such a manner that the axial line of the development roller pressing sleeve 17*e* is allowed to move in the direction parallel with the radial direction of the photosensitive drum 11. Also referring to FIGS. 5 and 6, within the elongated groove 19*c*, a coil spring 43*b*, the one end of which is provided with a contact plate 43*a*, is placed in a manner to press the development roller pressing sleeve 17*e* toward the axial line of the photosensitive drum 11.

This groove 19*e* also plays a role in regulating the moving direction of the development sleeve 18.

The developing means frame portion 17 is structured in such a way that the developing means frame portion 17 is made to pivot about the axial line of the hole 17*d* by the resiliency of a spring 44 in the direction to cause the gears (these the gears of the photosensitive drum 11 and development roller are not illustrated, but are meshed with each other), with which the photosensitive drum 11 and development roller are provided to drive the photosensitive drum 11 and development roller, to mesh deeper with each other as driving force applies to the development roller and the photosensitive drum 11. In other words, the developing means frame portion 17 is structured so that the driving force does not work in the direction to cause the photosensitive drum 11 and development sleeve 18 to separate from each other. Further, the development sleeve 18 is also kept pressed toward the photosensitive drum 11 by the above described development roller pressing sleeve 17*e*.

In other words, in this embodiment, the developing means frame portion 17 and toner holding frame portion 16 are movable relative to each other, and therefore, the two frame portions 17 and 16 are connected to each other, with the interposition of a sealing member 21 capable of tolerating the movement of the two frame portions 17 and 16 relative to each other within a predetermined range, to prevent toner leakage. The sealing member is desired to be shaped to be small in the resiliency which acts to interfere with the movement of the developing apparatus More specifically, it is desired to be shaped to have a minimum of one folding line, or preferably, to be in the form of a section of bellows.

The sealing member 21 in this embodiment is formed of elastomer, and has two folding lines (unillustrated) to reduce the resiliency. However, materials superior in flexibility such as foamed urethane, rubber with a low degree of hardness, silicone rubber, and the like, may be used as the material for the sealing member 21. In such a case, if the material is low in resiliency, the sealing member 21 can provide the same effects as if it had folding lines or was shaped like a section of bellows, even if it is not shaped to have folding lines or to look like a section of bellows.

Structure for Supplying Development Roller with Electrical Power, and Structure for Supportinq Magnetic Roll At this time, the structure for supplying the development roller with electrical power, and the structure for supporting the magnetic roll, in this embodiment, will be described in detail.

Figure 8:
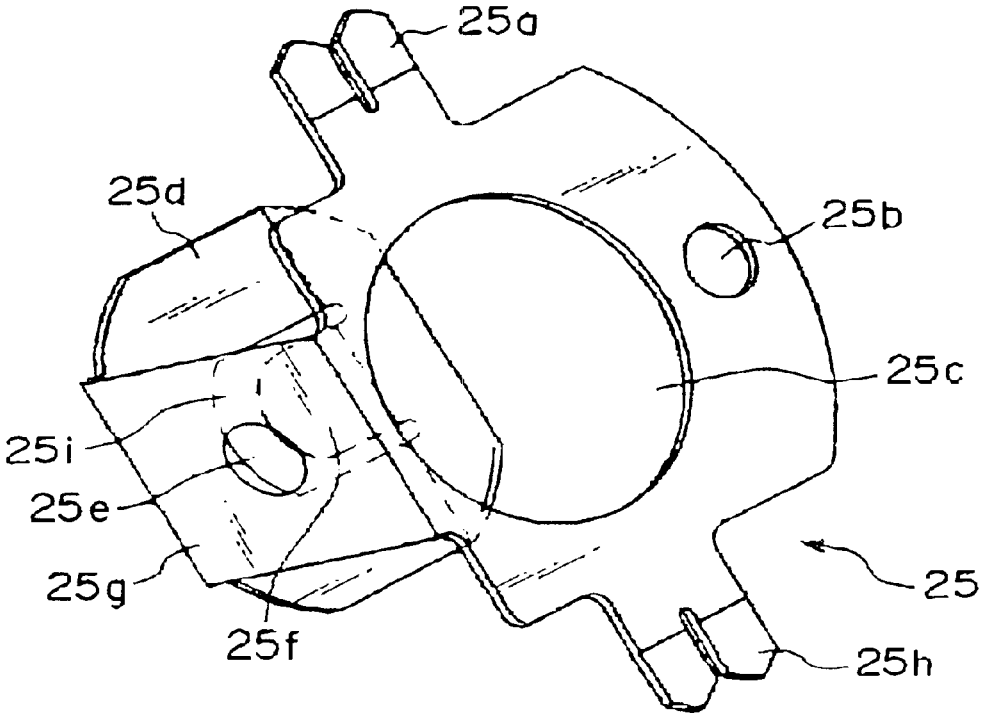
FIG. 8(*a*) is a perspective view of the contact plate on the sleeve side, and FIG. 8(*b*) is perspective view of the magnetic roll bearing.
Figure 8:
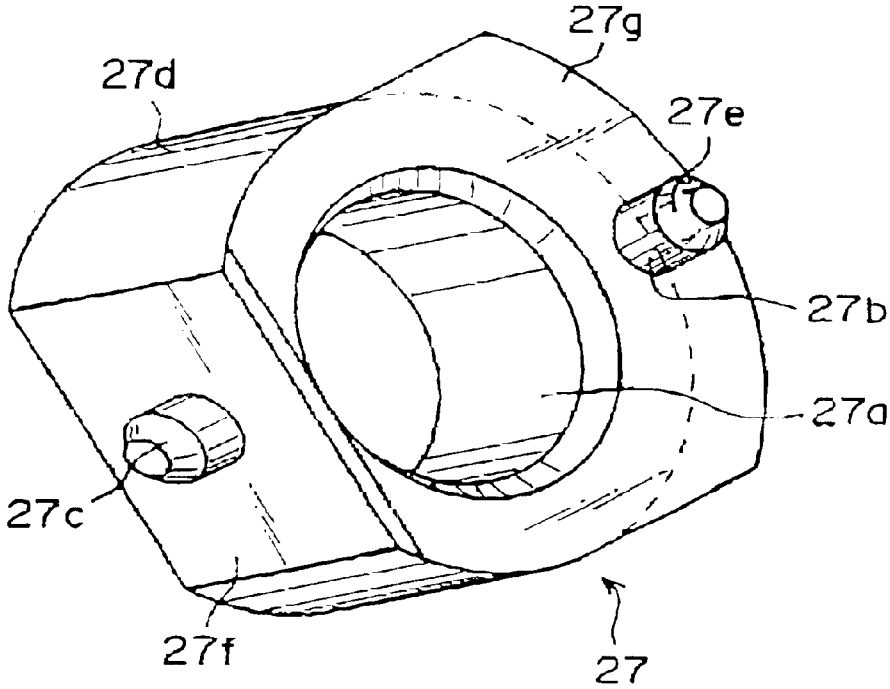
Figure 9:
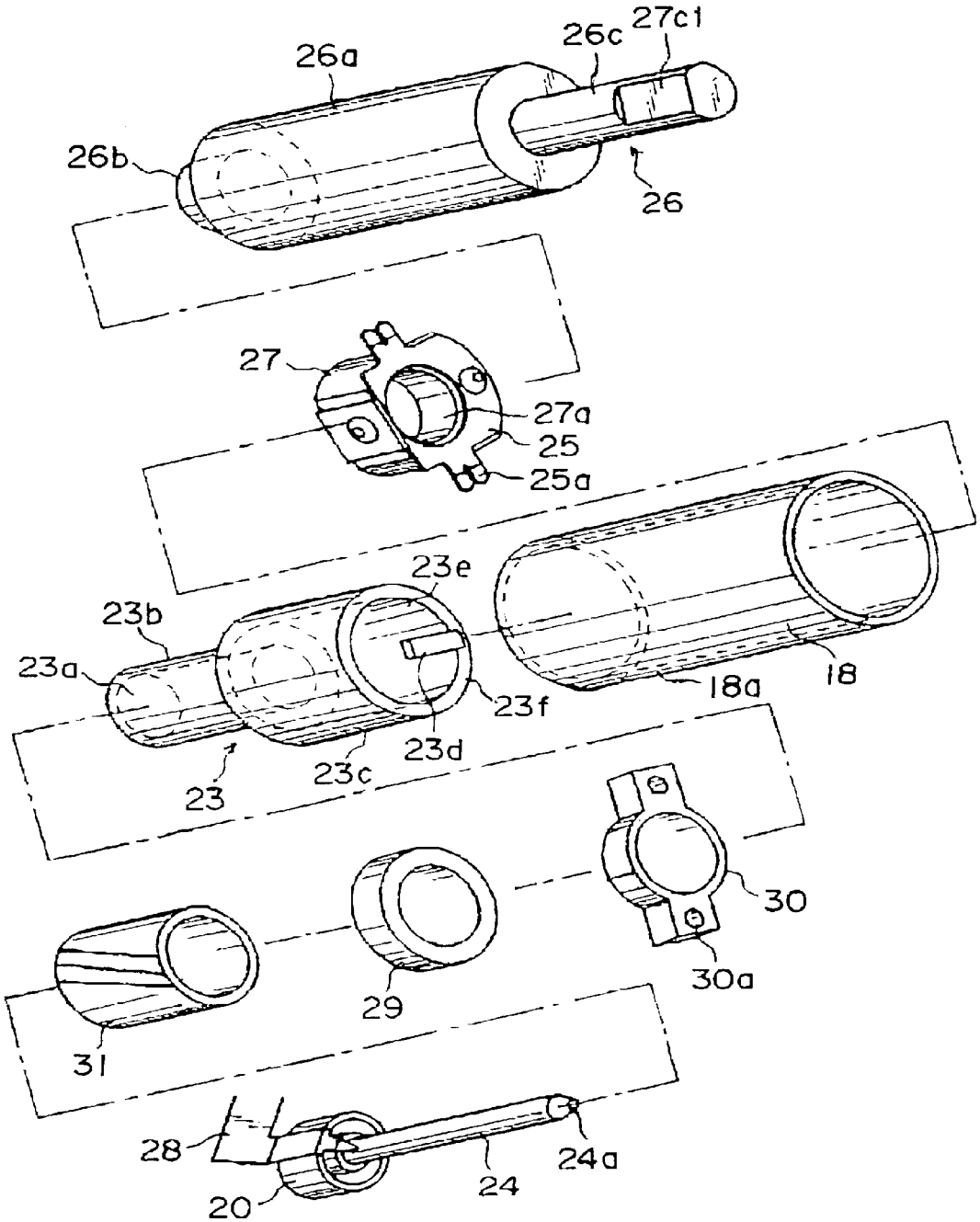
FIG. 9 is an exploded perspective view of the development roller in an embodiment of the present invention.
Figure 10:
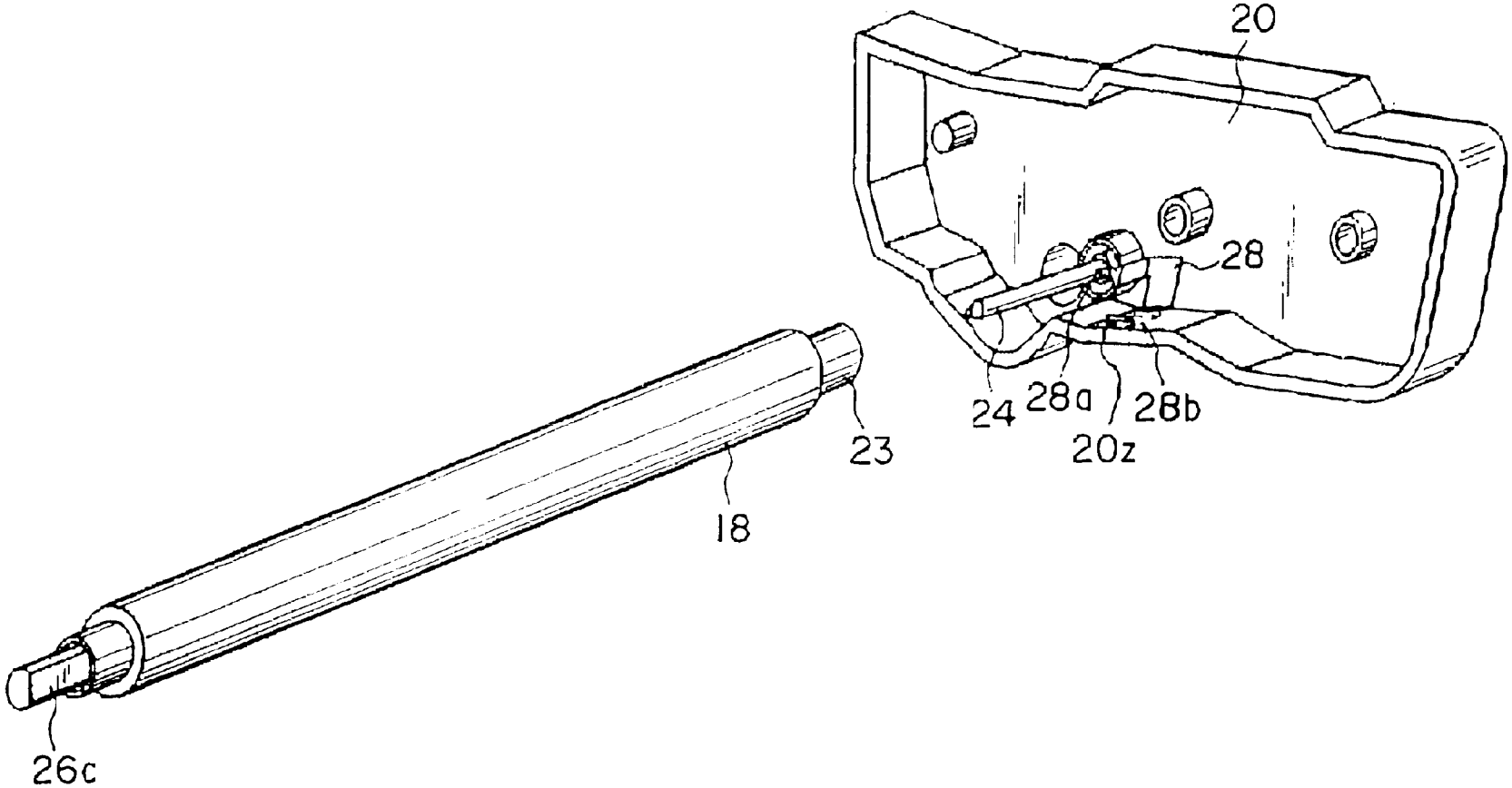
FIG. 10 is an exploded perspective view of the development roller and side cover in an embodiment of the present invention.
Figure 11:
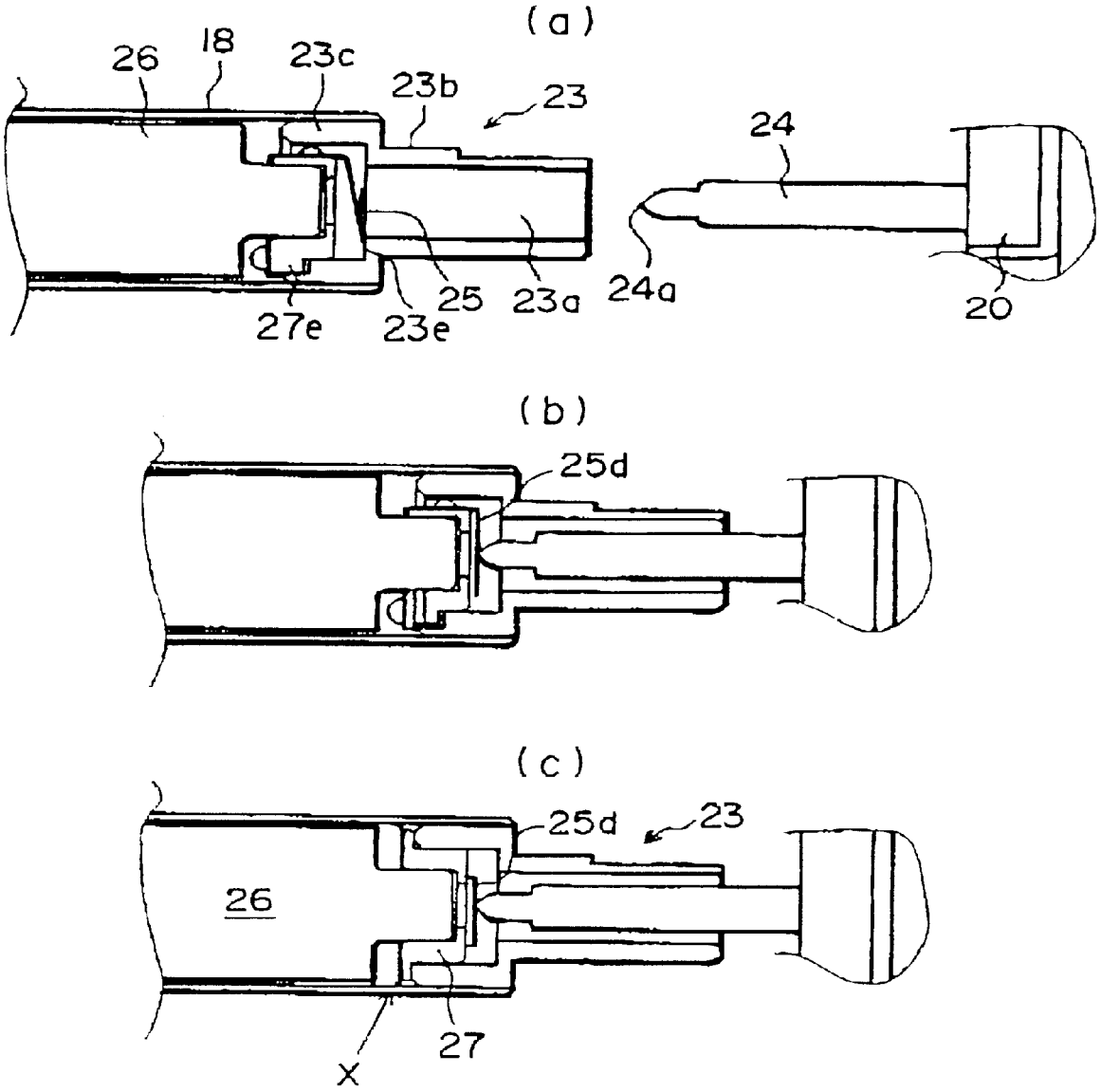
FIGS. 11(*a*), 11(*b*), and 11(*c*) are vertical sectional drawings for showing the order in which the development roller illustrated in FIG. 9 is assembled.
Figure 12:
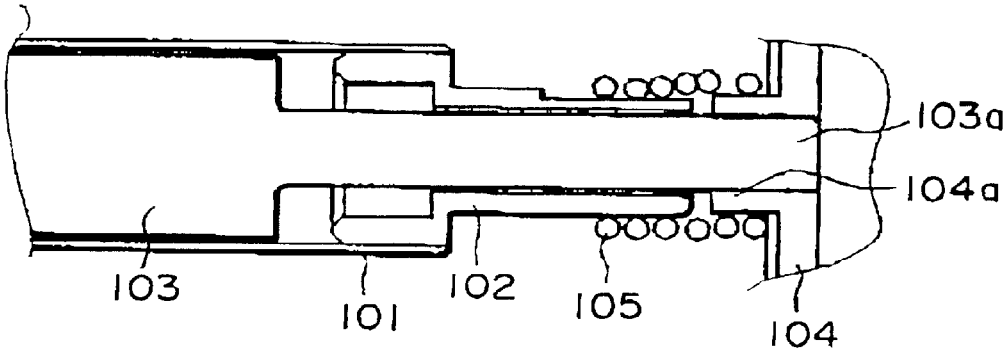
FIG. 12 is a vertical sectional view of the contact on the sleeve side of a conventional process cartridge, and its adjacencies.

FIG. 8(*a*) and FIG. 8(*h*) are perspective views of the sleeve contact plate 25 and magnetic roll bearing 27, respectively. FIG. 9 is an exploded perspective view of the components of the development roller prior to their assembly, and FIG. 10 is a perspective view of the development roller and side cover before they are put together. FIG. 11 is a sectional view of the development roller at a plane which includes the axial line of the development roller.

The development roller comprises the development sleeve 18, sleeve flange 23, and magnetic roll 26. Referring to FIG. 9, the development sleeve 18, or a component of the development roller, is a cylindrical member formed of metallic material such as aluminum, stainless steel, or the like, and is approximately 16–20 mm in external diameter, and approximately 0.5–1 mm in cylinder wall thickness. In order to improve the efficiency with which developer is charged, the surface of the development roller 18 is coated with carbon, is sandblasted, or is subjected to the like processes. In this embodiment, it is simply coated with carbon. Each of the longitudinal ends of the development sleeve 18 has a section into which a sleeve flange 23, which will be described later, is fixed by press-fitting.

Referring to FIG. 9, the sleeve flange 23 is formed of metallic material such as aluminum, stainless steel, or the like, and is fixed to each of the longitudinal ends of the development sleeve 18, by being pressed into the longitudinal end of the development sleeve 18. The sleeve flange 23 is a stepped cylindrical member. In FIG. 9, only the driven side is illustrated, but the nondriven side has the same structure.

The sleeve flange 23 is made up of a cylindrical portion 23*c* with a larger external diameter, and a cylindrical portion with a smaller external diameter compared to that of the larger external diameter portion. The cylindrical portion with the larger external diameter is a portion which is pressed into the through hole of the development sleeve 18 to fix the sleeve flange 23 to the development sleeve 18. The sleeve flange 23 is nonrotationally fixed to the development sleeve 18 by being pressed into the development sleeve 18 as described above. Thus, the sleeve flange 23 rotates with the development sleeve 18.

If the alignment between the development sleeve 18 and sleeve flange 23 is not proper, an image which is not uniform in density, or an image with the like defect, is likely to be produced. Therefore, the development sleeve 18 and sleeve flange 23 are precisely fixed to each other.

The sleeve flange 23 is also provided with a portion 23*e*, that is, a portion of the internal surface of the portion 23*c* to be pressed in, to which the magnetic roll bearing 27, which will be described later, is anchored, and a groove 23*d* for regulating the rotation of the magnetic roll bearing 27. The portion 23*e* and groove 23*d* are within the portion 23*c* to be pressed in.

A portion 23*b* of the sleeve flange 23 on the immediately outward side of the portion 23*c* is smaller in diameter than the portion 23*c*, and remains outside the development sleeve 18 after the pressing of the portion 23*c* of the sleeve flange 23 into the development sleeve 18. The axial lines of the portions 23*b* and 23*c* coincide.

Around the circumference of this portion 23*b* of the sleeve flange 23, a gap regulating member 29 for regulating the distance between the peripheral surfaces of the development sleeve 18 and photosensitive drum 11, a sleeve bearing 30 by which the development roller is rotationally supported by the developing means frame portion 17, and a sleeve gear 31 through which driving force is transmitted to the development sleeve 18 from the photosensitive drum 11 to rotate the development sleeve 18, are fitted.

The sleeve bearing 30 is fixed to the developing means frame portion 17; the sleeve bearing 30 is fitted in a bearing hole 30*a* of the developing means frame portion 17. Further, the sleeve gear 31 is nonrotationally fixed to the development roller. The sleeve gear 31 has a through hole 23, the axial line of which coincides with that of the outside portion 23*b* of the sleeve flange 23. Through this through hole 23*a*, a metallic electrode 24 in the form of a shaft, which will be described later, is put to transmit electrical power inward of the development sleeve 18. A surface 23*f* of the sleeve flange 23, or the inward surface, perpendicular to the longitudinal direction of the development roller, of the sleeve flange 23, is a surface for fixing the position of the magnetic roll bearing 27, which will be described later, in terms of the longitudinal direction of the development roller.

Referring to FIG. 9, the magnetic roll 26 has a portion 26*a* with a larger diameter, and two shaft portions 26*b* with a smaller diameter, located on each side of the portion 26*a*. The large diameter portion 26*a* is placed within the development roller, and is provided with a plurality of magnetic poles which are distributed in the circumferential direction of the magnetic roll 26 and are exposed at the peripheral surfaces of the magnetic roll 26. Normally, the magnetic roll 26 is positioned so that one of its magnetic poles squarely opposes the photosensitive drum 11 while the other poles are also properly distributed in terms of the circumferential direction of the magnetic roll 26. In this embodiment, the number of the magnetic poles is four.

In order to keep the magnetic force stable at the peripheral surface of the development sleeve 18, the distance between the peripheral surfaces of the large diameter portion 26*a* and the peripheral surfaces of the development sleeve 18 must be kept constant. In order to keep this distance constant, one of the shaft portions 26*c* is supported by the side cover 19 illustrated in FIG. 3. This shaft portion 26*c* is nonrotationally fitted in the development roller pressing sleeve 17*e*, and this development roller pressing sleeve 17*e* is fitted in the elongated groove 19*e* of side cover 19, being therefore supported by the side cover 19.

More specifically, the D-cut portion 26*c*1 of the shaft portion 26*c* is fitted into the hole of the development roller pressing sleeve 17*e*, with a D-shaped cross section, so that the positions of the magnetic poles in terms of the circumference direction of the development roller are fixed.

The shaft portion 26*b*, or the other shaft portion, of the magnetic roll 26 is supported by the magnetic roll bearing 27, which is anchored to the portion 23*d*, or a portion of the internal surface of the large diameter portion, of the sleeve flange 23. The portion 23*d* of the sleeve flange 23 will be described later.

Referring to FIGS. 8(*b*) and 9, the magnetic roll bearing 27 is a molded member with a D-shaped cross section.

The magnetic roller bearing 27 has a main portion 27*d* with the D-shaped cross section, a rotation controlling portion 27*c* in the form of a dowel. The main portion 27*d* has a flat surface 27*f* comparable to the straight line of a letter D. The main portion 27*d* with the D-shaped cross section is anchored to the portion 23*e* of-the sleeve flange 23 illustrated in FIG. 9, and the rotation controlling portion 27*c* is fitted in the groove 23*d*. Therefore, the magnetic, roll bearing 27 rotates with the sleeve flange 23.

The dowel-like rotation controlling portion 27*c* projecting from the flat surface 27*f* in the direction perpendicular to the axial line of the development sleeve 18, and the flat surface 27*f*, supports and accurately positions, the sleeve contact plate 25, which will be described later.

The bearing hole of the magnetic roll bearing 22 also doubles as a positioning hole 27*a*. This hole 27*a* is 5–10 mm in diameter, and 3–8 mm in depth. In order to precisely position the magnetic roll, the hole 27*a* is finished very precisely, more specifically, with its accuracy in internal diameter being in class 8–9, and its surface roughness R being at about 0.8 $\mu$m.

The magnetic roll 26 is nonrotationally fixed, whereas the magnetic roller bearing 27 and sleeve flame 23 rotate with the development sleeve 18. Therefore, the peripheral surfaces of the shaft portion 26*b* and the cylindrical surface of the hole 27*a* slide on each other. Therefore, a material superior in slipperiness against the magnetic roll 26, for example, PPF or the like, is used as the material for the magnetic roll bearing 27. Further, the magnetic roller bearing 27 has a collar portion 27*g*, which is placed in contact with the end surface 23*f* of the sleeve flame 23 to fix the position of the magnetic roller bearing 27 relative to the development sleeve 18 in terms of the longitudinal direction of the development roller, and a dowel-like projection 27*b* to which the sleeve contact plate 25 is fixed. The dowel-like projection 27*b* projects from the collar portion 27*g*.

Referring to FIGS. 8(*a*) and 9, the sleeve contact plate 25 is a U-shaped member having opening first and second portions virtually perpendicularly to the longitudinal direction of the development roller, and a rectangular center portion 25*g* which connects these first and second portions. It is formed of 0.1–0.3 mm thick plate of electrically conductive, springy material (for example, Cu alloy, or Fe alloy such as SUS). It is fixed to the magnetic roller bearing 27 in such a manner that the opposing two portions and rectangular portion 25*g* partially cover the end surfaces and flat surface 27*f* of the magnetic roller bearing 27, respectively. More specifically, the dowel-like projection 27*b* of the magnetic roller bearing 27 is fitted in a hole 25*b* formed in one of the opposing two portions of the sleeve contact plate 25, and the dowel-like rotational controlling portion 27*c* of the magnetic roll bearing 27 is fitted in the hole 25*e* formed in the rectangular portion 25*g* of the sleeve contact plate 25, with the rectangular portion 25*g* placed flatly in contact with the flat surface 27*f*, comparable to the straight line of a letter D, of the magnetic roller bearing 27.

The fixation of the dowel-like portions in the holes is accomplished by thermal welding supersonic welding, glueing, or the like methods. During this process, the dowel-like projections 27*c* and 27*e* of the magnetic roller bearing 27 are approximately semispherically reshaped. It should be noted here that although the dowel-like projection 27*c* is on the flat surface 27*f*, the dowel-like projection 27*c* after its semispherical reshaping is not high enough for the highest portion of the reshaped projection 27*c* to extend beyond the imaginary cylindrical extension of the cylindrical surface of the main potion 27*d* of the magnetic roller bearing 27. Therefore, the portion 23*e*, or a part of the internal surface of the sleeve flange 23 has only to be made cylindrical, eliminating the cost otherwise necessary for complicated processing.

The sleeve contact plate 25 is provided with arm portions 25*a* and 25*h* which contact the internal surface of the development sleeve 18, and are electrically connected with the development sleeve 18. These arm portions 25*a* and 25*h* are symmetrically positioned with respect to the rotational axis of the development sleeve 18. This positional arrangement is made to equalize the insertion resistance generated during the insertion of the sleeve contact plate 25 into the development sleeve 18. Referring to FIG. 11 (*c*), the arm portions 25*a* and 25*h* are bent at an acute angle relative to the magnetic roll bearing insertion direction so that, as the sleeve flange 23 is inserted into the development sleeve 18, the arm portions 25*a* and 25*h* are bent backward in terms of the direction in which the sleeve flange 23 is inserted as indicated by an X mark, in other words, they have bent in the direction to counter the force which works in the direction to move the magnetic roller bearing 27 out of the sleeve flange 23. Therefore, a problem such that the magnetic roll bearing 27 comes out of the sleeve flange 23 does not occur.

Further, as described above, the collar portion 27*g* of the magnetic roller bearing 27 contacts the end surface 23*f* of the sleeve flange 23, and therefore, the positions of the magnetic roller bearing 27 and sleeve contact plate 25 relative to the development sleeve 18 in terms of the longitudinal direction of the development roller are perfectly fixed. There is a through hole 25*c* between the arm portions 25*a* and 25*h*, which is slightly greater in diameter than the shaft portion 26*b* of the magnetic 20 roll 26, and the axial line of which coincides with that of the magnetic roll 26.

Therefore, while the magnetic roll 26 is supported by the magnetic roller bearing 27, the magnetic roll 26 does not contact the sleeve contact 25 plate 25. A portion 25*d*, or one of the opposing two portions of the sleeve contact plate 25, is provided with arm portion 25*f*, which is formed by cutting a slit through the portion 25*d* and bending the portion surrounded by the slit, to make it elastically contact the shaft-like electrode 24, which will be described later. This arm portion 25*f* is rendered springy. The portions of the sleeve contact plate 25 which elastically deform are the arm portion 25*f* sliced and bent out of the portion 25*d*, and the portion 25*d*.

In order to keep constant the contact pressure at the contact point between the arm portion 25*f* and the shaft-like electrode 24 even if the positional relationship between the shaft-like electrode 24 and arm portion 25*f* changes due to the change in the position of the development sleeve 18 in its longitudinal direction, the spring constant of the arm portion 25*f* is desired to be as small as possible. For that purpose, making longer the spring portions (portion 25*d*, or one of the opposing two portion of the sleeve contact plate 25, arm portion 25*f*, and the like) is effective.

Further, the spring portions should be give a certain length in consideration of fatigue. However, the range in, which the arm portion 25*f* is allowed to flex in terms of the direction perpendicular to the axial direction of the development roller is 10–15 mm in terms of the radial direction of the development roller, and in addition, the requirement that the overall size of the apparatus must be small, makes it impossible to elongate the arm portion 25*f* in the axial direction of the development roller. In this embodiment, therefore, a U-shaped hole 25*i* is punched out of the aforementioned spring portion 25 to provide the spring portion with a longer effective length, that is, the combined length of the portion 25*d* (peripheral edge) and the arm portion 25*f* (center portion).

Further, the arm portion 25*f* and portion 25*d* are bent relative to each other in terms of the axial direction of the development roller so that they form a letter Z as seen from the direction perpendicular to the axial direction of the development roller, and so that they settle in the same plane perpendicular to the axial line of the development roller as the shaft-like electrode 24 makes contact with the arm portion 25*f*.

Referring to FIGS. 9 and 10, the shaft-like electrode 24 projects from the inward surface of the side cover 20 in such a direction that the axial line of the shaft-like electrode 24 coincides with that of the development sleeve 18. The material for the shaft-like electrode 24 is plated steel, stainless steel, or the like. The shaft-like electrode 24 is 2 mm in external diameter. It is formed as an integer part of the side cover by insert molding, or nonrotationally and inseparably fixed to the side cover by being pressed into the side cover after the two are separately formed.

When the side cover 20 is attached, this shaft-like electrode 24 is put through the through hole 23*a* of the sleeve flange 23, and its tip portion 24*a* causes the arm portion 25*f* of the sleeve contact plate 25 to flex, so that a predetermined amount of contact pressure is maintained between the shaft-like electrode 24 and arm portion 25*f*. The tip portion 24*a* of the shaft-like electrode 24 is formed to be semispherical to assure that the sleeve contact plate 25 and arm portion 25*f* contact each other at a single point. This arrangement is made because the shaft-like electrode 24, which rotates, must be placed in contact with each other, and yet it must be placed in contact with each other, and yet it must be assured that electrical power is satisfactorily conducted through the interface in which the tip of the shaft-like electrode 24 and arm portion 25*f* slide on each other. With this arrangement, the shaft-like electrode 24 is positioned so that its axial line coincides with the rotational axis of the development sleeve 18, and therefore, the size of the range in which the tip of the shaft-like electrode 24 and arm portion 25*f* slide on each other is smaller. Further, in order to reduce the wear caused by the sliding, it is desirable that electrically conductive grease is placed in the interface between the tip portion 24*a* of the shaft-like electrode 24 and the arm portion 25*f*. It is assumed that the shaft-like electrode 24 does not contact the internal surface of the through hole 23*a* of the sleeve flame 23. This arrangement is made to prevent the shaft-like electrode 24 from affecting the position of the development sleeve 18. The base portion of the shaft-like electrode 24 is in contact with a contact plate 28 which contacts the contact on the main assembly side.

Referring to FIGS. 9 and 10, the contact plate 28 for contacting the main assembly is a 0.1–0.3 mm thick metallic (SUS, Cu alloy, or the like) springy plate, and is attached to the side cover 20 in such a manner that the actual contact portion 28*b* of the contact plate 28 is exposed from the process cartridge 15 through the hole 20*z* of the size cover 20 after the process cartridge assembly. It is structured so that when the process cartridge 15 is in the apparatus main assembly, it remains electrically in contact with the electrode (illustrated) in the apparatus main assembly.

The contact plate 28 is structured so that its tip portion 28*a* electrically contacts the shaft-like electrode 24. As for the method for keeping the shaft-like electrode 24 and contact plate 28 in contact with each other, a simple crimping method, a method in which the contact plate 28 is provided with a shaft-like electrode contacting elastic portion which is placed in contact with the shaft-like electrode 24, and the like methods, may be listed.

Further, a method, in which an electrically conductive member (for example, SUS plate) is attached to the shaft-like electrode 24 by crimping or the like, and this electrically conductive member is electrically connected to the contact plate 28, may be employed. Also, the shaft-like electrode 24 and the contact plate 28 may be integrally formed so that this integral combination of the shaft-like electrode 24 and contact plate 28 is attached to the side cover 20.

To repeat the above described structure following the order of assembly with reference to FIGS. 9 and 11, first, the press-fitting portion 23*c* of the sleeve flange 23 is pressed into the press-fitting hole 18*a* of the development sleeve 18, so that the sleeve flange 23 is perfectly immovably fixed to development sleeve 18. Next, the magnetic roller bearing 27 to which the sleeve contact plate 25 has been fixed is inserted into the development sleeve 18 from the side (right side in FIG. 9), into which the sleeve flange 23 has not been pressed, until the collar portion 27*g* contacts the end surface 23*f* of the sleeve flange 23. During this insertion of the magnetic roller bearing 27, it does not occur that the magnetic roller bearing 27 fits askew due to the insertion resistance, because the arm portions 25*a* and 25*h* are positioned with even intervals in terms of the circumferential direction of the sleeve flange 23. Also as described above, the magnetic roller bearing 27 remains accurately positioned relative to the development sleeve 18 by the force generated by the arm portions 25*a* and 25*h*. Next, the magnetic roll 26 is inserted into the development sleeve 18, and the other sleeve flange 23 (unillustrated) is fitted to complete the development roller.

Next, the gap regulating member 29, sleeve bearing 33, and sleeve gear 31 are attached to the developing means frame portion (unillustrated) in the listed order. FIG. 11(*a*) shows the development sleeve 18 at his stage of assembly. In this state, the arm portion 25*f* of the portion 25*d* of the sleeve contact plate 25 are yet to come into contact with the shaft-like electrode 24, and therefore, is simply in contact with the anchoring portion 23*e* or the internal surface of the sleeve flange 23.

Thereafter, as the side cover 20 is attached, the tip portion 24*a* of the shaft-like electrode 24 comes into contact with the arm portion 25*f* of the sleeve contact plate 25. In the state in which the attachment of the side covers 19 and 20 has been completed, the arm portion 25*f* of the portion 25*d*, and the portion 25*d*, are virtually in the same plane as seen from the direction perpendicular to the axial line of the development roller, contributing to the spacial efficiency in terms of the axial direction to the development roller.

Also in this state, the passage for electricity from the high voltage electricity supplying contact point (unillustrated) of the image forming apparatus main assembly to the development sleeve 18 through the contact plate 28, shaft-like electrode 24, and sleeve contact plate 25, has been completed.

In terms of the longitudinal direction of the development roller, the contact portions are located in the adjacencies of the inward and outward sides of the magnetic roller bearing 27, improving spacial efficiency in terms of the axial direction of the development roller. Further, the sliding contact point, or the only contact point, between the shaft-like electrode 24 and the sleeve contact plate 25, is located within the sleeve flange 23, and therefore, it is more difficult for contaminants such as dust to enter the contact point, stabilizing the performance of the contact point.

Further, the position of the magnetic roll 26 is fixed by the magnetic roller bearing 27 anchored to the internal surface of the sleeve flange 23, and therefore, the peripheral surfaces of the magnetic roll 26 and development sleeve 18 are positioned relative to each other with higher accuracy, and the distance between the two surfaces is kept more constant, compared to the prior structural arrangement.

As described above, according to the present invention, the contact pressure between the sliding first and second electrodes for applying bias voltage to a developer bearing member such as a development sleeve can be stabilized, and the sliding contact portions are located within the development sleeve. Therefore, the spacial efficiency in terms of the longitudinal direction of the process cartridge is improved. Further, placing the sliding contact portions within the development sleeve prevents contaminants such as dust from entering between the contact portions.

In particular, the magnetic roll bearing and the power supplying portion of the development roller are located close to each other, and therefore, spacial efficiency in terms of the longitudinal direction of the development roller is improved.

Further, the position of the magnetic roll is fixed by the internal surface of developer bearing member such as a development sleeve, with the interposition of the magnetic roll bearing as the magnetic roll holder, and therefore, the position of the magnetic roll relative to the development sleeve is fixed with high accuracy.

While the invention has been described with reference to the structures disclosed herein, it is not confined to the details set forth and this application is intended to cover such modifications or changes as may come within the purposes of the improvements or the scope of the following claims.

What is claimed is:

1. A developing device comprising:

a rotatable developer carrying member for carrying a developer;

a magnet provided in said developer carrying member;

a bearing supporting an end portion of said magnet, said bearing being provided inside said developer carrying member and being rotatable integrally with said developer carrying member;

a first electrode portion electrically connected with said developer carrying member, said first electrode portion being rotatable with said developer carrying member; and a second electrode portion for electrically connecting said first electrode portion and an outside of said developer carrying member, and wherein a contact portion between said first electrode portion and said second electrode portion is disposed outside said bearing with respect to a longitudinal direction of said developer carrying member.

2. A device according to claim 1, wherein said contact portion is inside said developer carrying member.

3. A device according to claim 2, wherein said second electrode portion is provided with a shaft portion extended outwardly of said developer carrying member from said contact portion at a center of rotation of said developer carrying member.

4. A device according to claim 1, wherein said magnet is nonrotatable.

5. A device according to claim 1, wherein said first electrode portion is provided with a contact portion contactable to said contact portion, and said contact portion of said first electrode portion is displaceable in a longitudinal direction of said developer carrying member.

6. A device according to claim 1, wherein said developer carrying member includes a developing sleeve and a flange which is provided at an end of said developing sleeve and which is supported rotatablely by a developing frame.

7. A device according to claim 6, further comprising a bearing member supporting a longitudinal end portion of said magnet, wherein said bearing member is mounted on said flange and is rotatable relative to said longitudinal direction end portion together with said flange.

8. A device according to claim 7, wherein said first electrode portion is supported by said bearing member.

9. A device according to claim 8, wherein said bearing member is electrically insulative.

10. A device according to claim 7, wherein said flange is press-fitted in said developing sleeve, and said bearing member is press-fitted in said flange.

11. A device according to claim 7, wherein said second electrode portion penetrates through said flange without contacting said flange.

12. A device according to claim 1, wherein said first electrode portion is provided with a contact portion contacted to an inner surface of said developer carrying member.

13. A device according to claim 8, wherein said first electrode portion is provided with a contact portion contacted to an inner surface of said developer carrying member at inside position of said developer carrying member, with respect to a longitudinal direction of said developer carrying member, of a portion where said magnet is supported by said bearing member.

14. A device according to claim 12, wherein said first electrode portion is provided with an arm portion extended at an acute angle relative to a direction in which said first electrode portion is inserted into said developer carrying member, and said arm portion supports said contact portion of said first electrode portion.

15. A device according to claim 9, wherein said contact portion of said second electrode portion is provided so as to overlap with said flange in a longitudinal direction of said developer carrying member.

16. A device according to claim 8, wherein said first electrode portion is provided with a first flat surface portion and a second flat surface portion which are extended substantially perpendicularly to a longitudinal direction of said developer carrying member, and a connecting portion connecting said first flat surface portion and said second flat surface portion, wherein said second flat surface portion is provided outwardly beyond said first flat surface portion with respect to the longitudinal direction of said developer carrying member and contacts said contact portion of said second electrode portion.

17. A device according to claim 16, wherein said second flat surface portion provides an elastically deformable contact portion in contact with said contact portion of said second electrode portion and is provided with a contact portion provided inside an U-shaped cut-away portion, and said second flat surface portion is Z-shaped in a longitudinal section along said developer carrying member when said contact portion of said second electrode portion is not contacted to said second flat surface portion.

18. A device according to claim 8, wherein said magnet is inserted into said developing sleeve after said bearing member supported on said first electrode portion is inserted into said developing sleeve supporting said flange.

19. A device according to claim 1, further comprising a developing frame supporting said developer carrying member and a developer accommodation frame for accommodating a developer to be supplied to said developing frame, wherein said developing frame is swingable relative to an image bearing member frame supporting an image bearing member, and wherein said developer accommodation frame is nonmovable relative to said image bearing member frame.

20. A device according to any one of claims 1–18, wherein said developing device is provided in a process cartridge detachably mountable to a main assembly of image forming apparatus together with the image bearing member.

21. A device according to claim 19, wherein said developing device and said image bearing member are provided in a process cartridge which is detachably mountable to a main assembly of an image forming apparatus.

22. A device according to claim 21, wherein said process cartridge comprises said image bearing member frame, a side cover supporting said image bearing member frame and said developer accommodation frame at a longitudinal end portion of said image bearing member and a third electrode portion electrically connected with said second electrode portion and connectable to an electrode member provided in the main assembly of said image forming apparatus.

* * * * *

UNITED STATES PATENT AND TRADEMARK OFFICE

CERTIFICATE OF CORRECTION

PATENT NO. : 6,473,578 B2
DATED : October 29, 2002
INVENTOR(S) : Shigeo Miyabe et al.

It is certified that error appears in the above-identified patent and that said Letters Patent is hereby corrected as shown below:

Title page,
Item [56], OTHER PUBLICATIONS, "U.S. patent applicatin" should read -- U.S. patent application --.
Item [57], ABSTRACT,
Line 2, "carring" should read -- carrying --.

Column 2,
Line 12, "it, s" should read -- it is --; and
Line 60, "is" should read -- is a --.

Column 3,
Line 31, "leans" should read -- means --.

Column 4,
Line 1, "S Then," should read -- S. Then, --.

Column 5,
Line 46, "relative" should read -- relative to --;
Line 49, "to" should read -- of --;
Line 58, "18 The" should read -- 18. The --; and
Line 61, ".detail" should read -- detail --.

Column 6,
Line 11, "trade" should read -- frame --; and
Line 65, "apparatus" should read -- apparatus. --.

Column 7,
Line 13, "Supportinq" should read -- Supporting --.

Column 9,
Line 14, "magnetic," should read -- magnetic --; and
Line 29, "flame" should read -- flange --.

UNITED STATES PATENT AND TRADEMARK OFFICE

CERTIFICATE OF CORRECTION

PATENT NO. : 6,473,578 B2
DATED : October 29, 2002
INVENTOR(S) : Shigeo Miyabe et al.

It is certified that error appears in the above-identified patent and that said Letters Patent is hereby corrected as shown below:

Column 10,
Line 39, “20” should be deleted;
Line 43, “25” (first occurrence) should be deleted;
Line 61, “portion” should read -- portions --;
Line 64, “give” should read -- given --; and
Line 65, “in,” should read -- in --.

Column 11,
Line 51, “flame” should read -- flange --.

Column 13,
Line 29, “of” should read -- of an --.

Column 14,
Line 11, “rotatabley” should read -- rotatably --; and
Line 63, “an” should read -- a --.

Signed and Sealed this

Eighth Day of April, 2003

JAMES E. ROGAN
*Director of the United States Patent and Trademark Office*